US007926471B2

(12) United States Patent
Freese, V

(10) Patent No.: US 7,926,471 B2
(45) Date of Patent: Apr. 19, 2011

(54) HEAT EXCHANGER WITH VARIABLE TURBULENCE GENERATORS

(75) Inventor: Charles E. Freese, V, Ira Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 497 days.

(21) Appl. No.: 12/144,690

(22) Filed: Jun. 24, 2008

(65) Prior Publication Data

US 2009/0314265 A1 Dec. 24, 2009

(51) Int. Cl.
*F02M 25/07* (2006.01)
*F02B 47/08* (2006.01)
*F28F 9/02* (2006.01)

(52) U.S. Cl. ..... 123/568.12; 165/174

(58) Field of Classification Search ..... 123/568.12; 60/320, 321, 605.2; 165/41, 51, 151–153, 165/157, 166, 167, 172, 174–177, 183
See application file for complete search history.

(56) References Cited

U.S. PATENT DOCUMENTS

| | | | | |
|---|---|---|---|---|
| 4,981,170 | A * | 1/1991 | Dierbeck | 165/174 |
| 6,971,378 | B2 * | 12/2005 | Mackey et al. | 123/568.12 |
| 7,069,918 | B2 * | 7/2006 | Mackey et al. | 123/568.12 |
| 7,478,630 | B2 * | 1/2009 | Maucher et al. | 123/568.12 |
| 7,661,415 | B2 * | 2/2010 | Nakamura | 123/568.12 |
| 7,797,937 | B2 * | 9/2010 | Endicott et al. | 123/568.12 |
| 2006/0174611 | A1 * | 8/2006 | Dilley et al. | 123/568.12 |
| 2009/0056682 | A1 * | 3/2009 | Okawa et al. | 123/568.12 |
| 2009/0313972 | A1 * | 12/2009 | Freese, V | 123/568.12 |

* cited by examiner

*Primary Examiner* — Willis R Wolfe, Jr.
(74) *Attorney, Agent, or Firm* — Harness, Dickey & Pierce, P.L.C.

(57) ABSTRACT

An exhaust gas recirculation cooler may include a housing and a first wall. The housing may include an exhaust gas region, a coolant region, an exhaust gas inlet, and an exhaust gas outlet. The first wall may be fixed within the housing and may separate the exhaust gas region from the coolant region. The first wall may include a first region facing the exhaust gas region and a first tab having a fixed end coupled to the first region and a free end generally opposite the fixed end. The free end may be displaceable between first and second positions based on an operating temperature of the exhaust gas. The free end may be displaced in a direction generally perpendicular to the first region when in the second position.

19 Claims, 2 Drawing Sheets

HEAT EXCHANGER WITH VARIABLE TURBULENCE GENERATORS

FIELD

The present disclosure relates to heat exchangers, and more specifically to an exhaust gas recirculation cooler.

BACKGROUND

Engine assemblies may include exhaust gas recirculation systems to reduce exhaust emissions. Exhaust gas recirculation systems may include a heat exchanger to reduce a temperature of recirculated exhaust gas. In diesel engines, a particulate matter may be present in the exhaust gas. The particulate matter may contaminate the heat exchanger, reducing heat transfer between the exhaust gas and the heat exchanger as well as restricting exhaust gas flow through the heat exchanger. Turbulent exhaust gas flow within the heat exchanger may increase heat exchange between the exhaust gas and the heat exchanger.

SUMMARY

An exhaust gas recirculation cooler may include a housing and a first wall. The housing may include an exhaust gas region, a coolant region, an exhaust gas inlet that provides communication between an exhaust gas from an engine and the exhaust gas region, and an exhaust gas outlet that provides communication between the exhaust gas region and an engine intake air supply. The first wall may be fixed within the housing and may separate the exhaust gas region from the coolant region. The first wall may include a first region facing the exhaust gas region and a first tab having a fixed end coupled to the first region and a free end generally opposite the fixed end. The free end may be displaceable between first and second positions based on an operating temperature of the exhaust gas. The free end may be displaced in a direction generally perpendicular to the first region when in the second position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
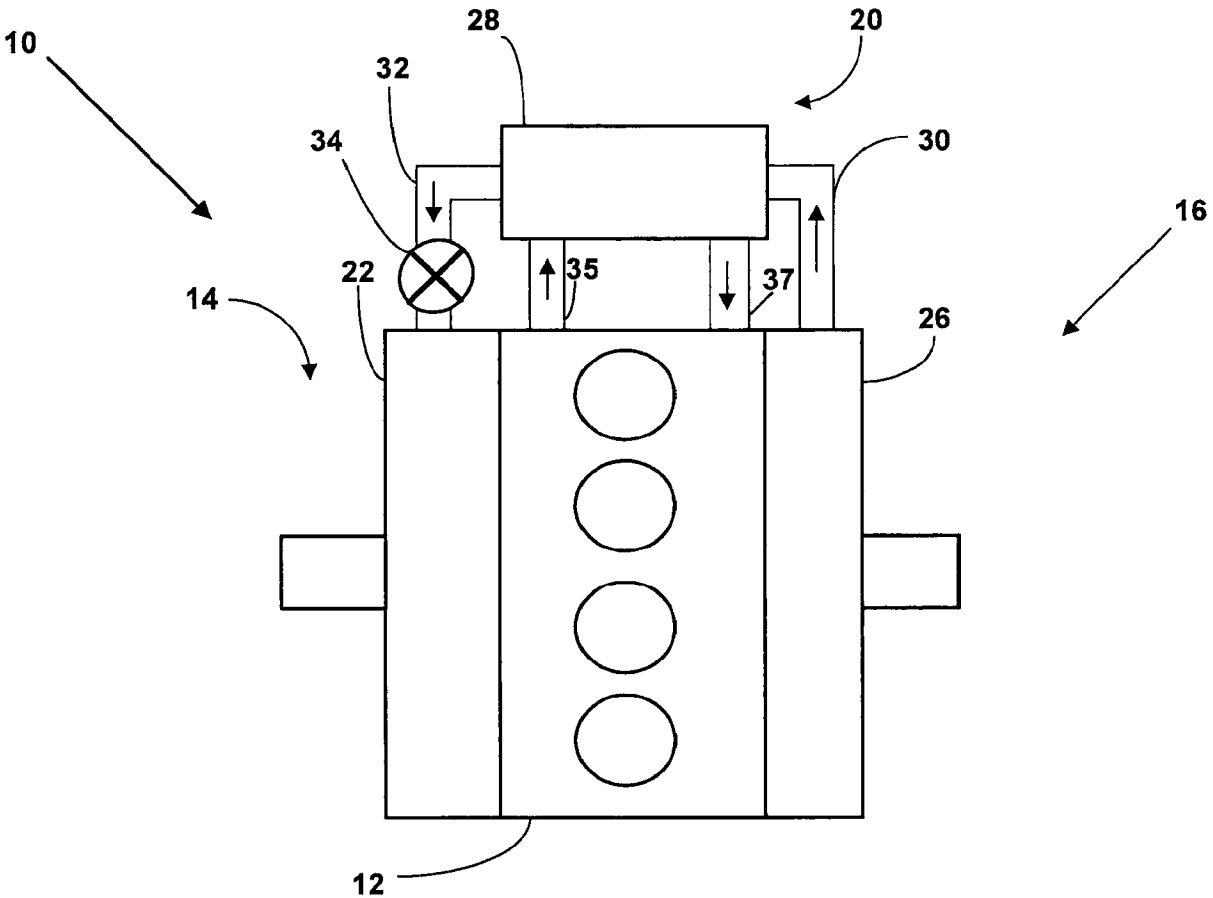
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an exemplary engine assembly 10 is schematically illustrated. Engine assembly 10 may include a diesel engine 12 in communication with an intake system 14, an exhaust system 16 and an exhaust gas recirculation (EGR) system 20. Intake system 14 may include an intake manifold 22 and may control an air flow into engine 12. Exhaust system 16 may include an exhaust manifold 26 in communication with exhaust gas created by combustion. The exhaust gas may exit engine 12 through exhaust system 16.

EGR system 20 may provide selective communication between intake system 14 and exhaust system 16. EGR system 20 may include an EGR cooler 28, exhaust gas inlet and outlet lines 30, 32, an EGR valve 34 and coolant inlet and outlet lines 35, 37. Exhaust gas inlet line 30 may provide fluid communication between exhaust manifold 26 and EGR cooler 28 and exhaust gas outlet line 32 may provide fluid communication between EGR cooler 28 and intake manifold 22. EGR valve 34 may be disposed between EGR cooler 28 and intake manifold 22 and may selectively control an amount of exhaust gas provided to intake manifold 22. Coolant inlet and outlet lines 35, 37 may be in communication with a cooling system (not shown) of engine 12 and may provide engine coolant flow to and from EGR cooler 28.

Figure 2:
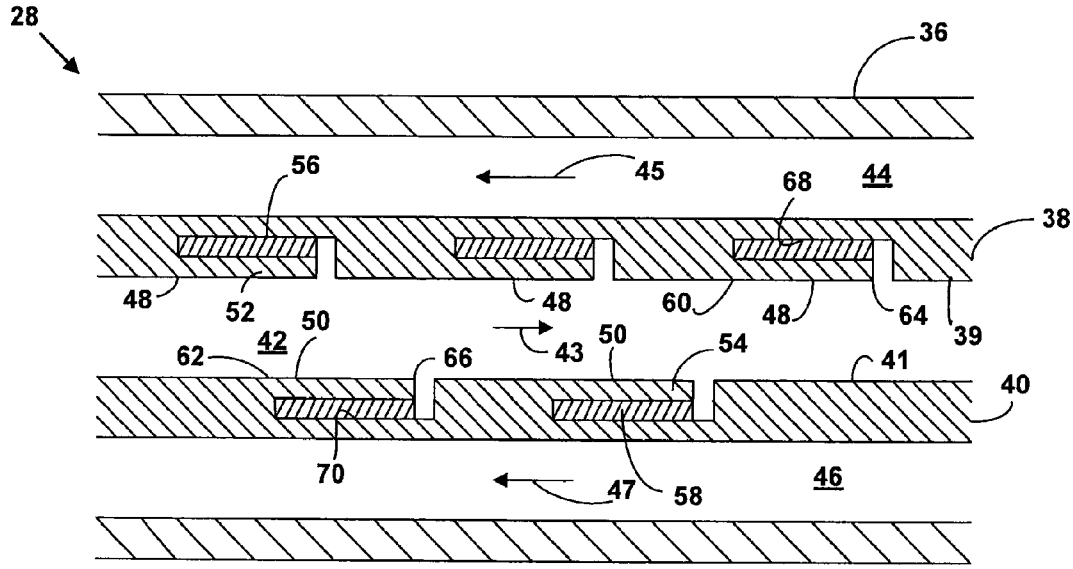
FIG. 2 is a schematic illustration of the cooler of the engine assembly shown in FIG. 1 during a first condition.
Figure 3:
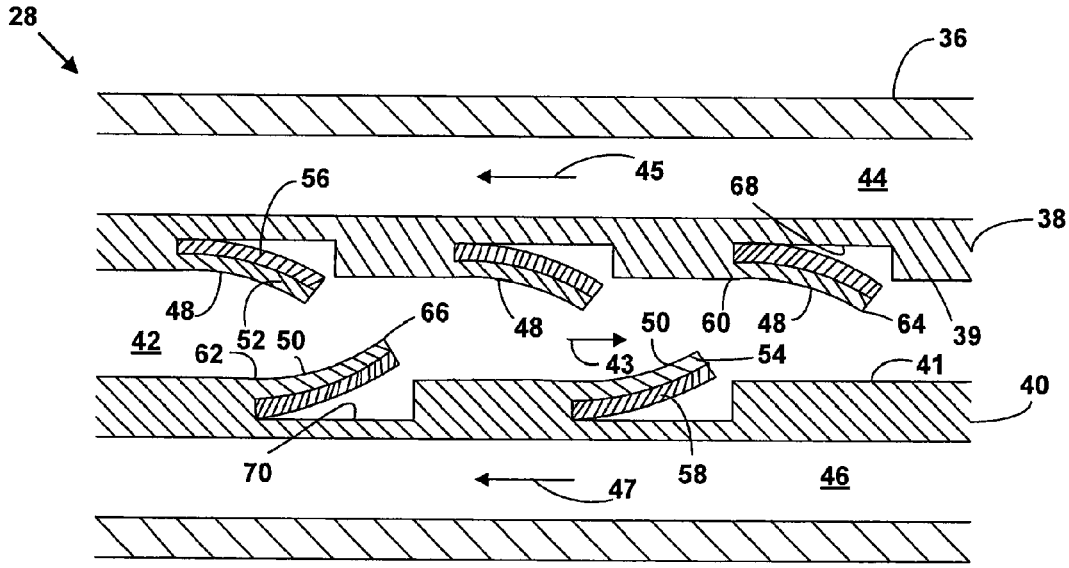
FIG. 3 is a schematic illustration of the cooler of FIG. 2 during a second condition.

With reference to FIGS. 2 and 3, EGR cooler 28 may be a plate-type cooler including an outer housing 36 having first and second walls 38, 40 fixed therein. It is understood that the structure of EGR cooler 28 may be applied to a variety of cooler applications, such as industrial coolers. Housing 36 and first and second walls 38, 40 may cooperate to form an exhaust gas region 42 and coolant regions 44, 46. Exhaust gas may flow within exhaust gas region 42 in the direction indicated by arrow 43. Coolant may flow within coolant regions 44, 46 in the direction indicated by arrows 45, 47. Ends of first and second walls 38, 40 may be fixed within housing 36 to isolate exhaust gas region 42 and coolant regions 44, 46 from one another. Exhaust gas region 42 may be in communication with exhaust gas inlet and outlet lines 30, 32 and coolant regions 44, 46 may be in communication with coolant inlet and outlet lines 35, 37.

First wall 38 may include a first region 39 and second wall 40 may include a second region 41. First and second regions 39, 41 may face exhaust gas region 42 and one another. First wall 38 may include a first series of tabs 48 fixed to first region 39 and second wall 40 may include a second series of tabs 50 fixed to second region 41. First tabs 48 may include first and second portions 52, 56 and second and second tabs 50 may include first and second portions 54, 58. First portions 52, 54 may be formed from a first material and second portions 56, 58 may be formed from a second material. The first and second materials may be different from one another. More specifically, the first and second materials may include metals having different coefficients of thermal expansion. Second portions 56, 58 may be fixed to first portions 52, 54 in a variety of ways including brazing in order to prevent separation based on the different coefficients of thermal expansion.

First tabs 48 may include fixed and free ends 60, 64 and second tabs 50 may include fixed and free ends 62, 66. Free end 64 of first tab 48 may be located downstream relative to fixed end 60 and free end 66 of second tab 50 may be located downstream of fixed end 62 in a flow direction of exhaust gas in exhaust gas region 42. Fixed end 60 of first tab 48 may be axially offset relative to fixed end 62 of a corresponding second tab 50 in the flow direction of exhaust gas within exhaust gas region 42. As such, free end 64 of one of first tabs 48 may be located downstream of free end 66 of a corresponding second tab 50.

Fixed end 60 of first tab 48 may be fixed to first region 39 and fixed end 62 of second tab 50 may be fixed to second region 41. More specifically, first portion 52 of first tab 48 may be fixed to first region 39 of first wall 38. First portion 54 of second tab 50 may be fixed to second region 41 of second wall 40.

First portion 52 may extend from first region 39 and may be integrally formed therewith. First portion 54 may extend from second region 41 and may be integrally formed therewith. As such, first and second regions 39, 41 may be formed from the first material. Free end 64 of first tab 48 may be located generally opposite fixed end 60 and free end 66 of second tab 50 may be located generally opposite fixed end 62. Second portion 56 may be fixed to an inner surface of first portion 52 and second portion 58 may be fixed to an inner surface of first portion 54. A recess 68 may be located within first wall 38 generally beneath first tab 48 and a recess 70 may be located within second wall 40 generally beneath second tab 50.

Free end 64 may be transversely displaceable from a first position (FIG. 2) to a second position (FIG. 3) relative to fixed end 60 and free end 66 may be transversely displaceable from a third position (FIG. 2) to a fourth position (FIG. 3) relative to fixed end 62 based on a difference in the coefficient of thermal expansion of the first and second materials. Therefore, free end 64 may be displaceable relative to first region 39 of first wall 38 and free end 66 may be displaceable relative to second region 41 of second wall 40. First tab 48 and free end 64 may be located in recess 68 when in the first position and may be displaced therefrom when in the second position. Second tab 50 and free end 66 may be located in recess 70 when in the third position and may be displaced therefrom when in the fourth position. First tab 48 may extend generally parallel to first wall 38 and second tab 50 may extend generally parallel to second wall 40 when free end 64 is in the first position and free end 66 is in the third position.

More specifically, free end 64 may be displaced in a direction generally perpendicular to first region 39 of first wall 38 when in the second position and free end 66 may be displaced in a direction generally perpendicular to second region 41 of second wall 40 when in the second position. Free ends 64, 66 may generally extend into exhaust gas region 42 when free end 64 is in the second position and free end 66 is in the fourth position. When free end 64 is in the second position and free end 66 is in the fourth position, a flow restriction of exhaust gas within exhaust gas region 42 may be increased relative to a flow restriction therein when free end 64 is in the first position and free end 66 is in the third position.

In a first arrangement, the second material may have a greater coefficient of thermal expansion than the first material. In this arrangement, as the temperature of exhaust gas within exhaust gas region 42 increases, first tab 48 may be displaced from the first position (FIG. 2) to the second position (FIG. 3) and second tab 50 may be displaced from the third position (FIG. 2) to the fourth position (FIG. 3). Displacement of first and second tabs 48, 50 to the second and fourth positions may generate turbulent exhaust gas flow within exhaust gas region 42 and provide greater heat transfer from exhaust gas region 42 to coolant regions 44, 46. Additionally, displacement of first and second tabs 48, 50 may remove particulate exhaust matter therefrom and increase a flow restriction within exhaust gas region 42, generating increased flow velocities for removal of the particulate exhaust matter from exhaust gas region 42.

In a second arrangement, the first material may have a greater coefficient of thermal expansion than the second material. In this arrangement, as the temperature of exhaust gas within exhaust gas region 42 decreases, first tab 48 may be displaced from the first position (FIG. 2) to the second position (FIG. 3) and second tab 50 may be displaced from the third position (FIG. 2) to the fourth position (FIG. 3). Displacement of first and second tabs 48, 50 to the second and fourth positions may provide a flow restriction within exhaust gas region 42 during cold-start engine conditions.

What is claimed is:

1. An exhaust gas recirculation cooler comprising:

a housing including an exhaust gas region, a coolant region, an exhaust gas inlet that provides communication between an exhaust gas from an engine and the exhaust gas region, and an exhaust gas outlet that provides communication between the exhaust gas region and an engine intake air supply; and a first wall fixed within the housing and separating the exhaust gas region from the coolant region, the first wall including a first region facing the exhaust gas region and a first tab having a fixed end coupled to the first region and a free end generally opposite the fixed end, the free end being displaceable between first and second positions based on an operating temperature of the exhaust gas, the free end being displaced in a direction generally perpendicular to the first region when in the second position.

2. The exhaust gas recirculation cooler of claim 1, wherein the free end generates turbulent exhaust gas flow when in the second position.

3. The exhaust gas recirculation cooler of claim 1, wherein the free end of the first tab is located downstream of the fixed end in a flow direction of the exhaust gas.

4. The exhaust gas recirculation cooler of claim 1, wherein displacement of the free end removes a particulate matter from the first tab.

5. The exhaust gas recirculation cooler of claim 1, wherein displacement of the free end from the first position to the second position occurs as the operating temperature of the exhaust gas increases.

6. The exhaust gas recirculation cooler of claim 1, wherein the first tab extends at an angle relative to the first portion when the free end is in the second position.

7. The exhaust gas recirculation cooler of claim 1, wherein the first tab extends generally parallel to the first portion when the free end is in the first position.

8. The exhaust gas recirculation cooler of claim 1, wherein the first tab includes first and second portions, the first portion being formed from a first material and the second portion being formed from a second material, the first portion including an outer surface facing the exhaust gas region and an inner surface having the second portion coupled thereto, one of the first and second materials having a coefficient of thermal expansion that is greater than the other of the first and second materials.

9. The exhaust gas recirculation cooler of claim 8, wherein the second material has a coefficient of thermal expansion that is greater than a coefficient of thermal expansion of the first material.

10. The exhaust gas recirculation cooler of claim 8, wherein the first material has a coefficient of thermal expansion that is greater than a coefficient of thermal expansion of the second material.

11. The exhaust gas recirculation cooler of claim 8, wherein the displacement of the free end is caused by a difference in the coefficient of thermal expansion of the first and second materials.

12. The exhaust gas recirculation cooler of claim 8, wherein the first region of the first wall is formed from the first material.

13. The exhaust gas recirculation cooler of claim 1, wherein displacement of the free end from the first position to the second position occurs as the operating temperature of the exhaust gas decreases.

14. The exhaust gas recirculation cooler of claim 13, wherein the first tab restricts a flow of the exhaust gas as the operating temperature of the exhaust gas decreases.

15. The exhaust gas recirculation cooler of claim 1, further comprising a second wall fixed within the housing, the second wall including a second region facing the exhaust gas region and the first region of the first wall, a second tab having a fixed end coupled to the second region of the second wall and a free end generally opposite the fixed end thereof, the free end of the second tab being displaceable between third and fourth positions based on an operating temperature of the exhaust gas.

16. The exhaust gas recirculation cooler of claim 15, wherein the free end of the second tab is displaced in a direction toward the first wall when in the fourth position.

17. The exhaust gas recirculation cooler of claim 15, wherein the free ends of the first and second tabs extend toward one another when the first tab is in the second position and the second tab is in the fourth position.

18. The exhaust gas recirculation cooler of claim 15, wherein the free end of the first tab is located downstream relative to the free end of the second tab in a flow direction of the exhaust gas.

19. The exhaust gas recirculation cooler of claim 15, wherein the free end of the second tab is displaced in a direction generally perpendicular to the second region when in the second position.

* * * * *